US009494326B2

(12) United States Patent
Collins

(10) Patent No.: US 9,494,326 B2
(45) Date of Patent: Nov. 15, 2016

(54) APPARATUS FOR GENERATING HEAT

(71) Applicant: Mark Collins, Burwash Common (GB)

(72) Inventor: Mark Collins, Burwash Common (GB)

( * ) Notice: Subject to any disclaimer, the term of this patent is extended or adjusted under 35 U.S.C. 154(b) by 41 days.

(21) Appl. No.: 14/617,255

(22) Filed: Feb. 9, 2015

(65) Prior Publication Data

US 2015/0323201 A1 Nov. 12, 2015

Related U.S. Application Data

(63) Continuation of application No. 13/500,532, filed as application No. PCT/BG2010/001884 on Oct. 7, 2010, now abandoned.

(30) Foreign Application Priority Data

Oct. 7, 2009 (GB) ..... 0917546.4

(51) Int. Cl.
*F24J 1/00* (2006.01)
*F24D 19/10* (2006.01)
(Continued)

(52) U.S. Cl.
CPC ..... *F24D 19/1006* (2013.01); *F22B 1/18* (2013.01); *F24D 3/00* (2013.01); *F24H 1/00* (2013.01); *F24J 1/00* (2013.01); *F24D 2200/16* (2013.01)

(58) Field of Classification Search
CPC ..... F01K 3/188; F24J 1/00; F24J 1/0045; A47J 36/30; A47J 36/28; B60H 1/22; B65D 81/3484; C09K 5/16
(Continued)

(56) References Cited

U.S. PATENT DOCUMENTS 387,087 A 7/1888 MacLaughin
387,088 A 7/1888 MacLaughin
(Continued)

FOREIGN PATENT DOCUMENTS

DE 3539710 A1 5/1987
DE 3819202 A1 * 9/1989 ..... F24D 11/002
(Continued)

OTHER PUBLICATIONS

International Search Report for PCT/GB2010/001884 dated Feb. 13, 2012.
UK IPO Search Report for GB0917546.4 dated Nov. 26, 2009.

*Primary Examiner* — Gregory Huson
*Assistant Examiner* — Daniel E Namay
(74) *Attorney, Agent, or Firm* — Heslin Rothenberg Farley & Mesiti P.C.

(57) ABSTRACT

An apparatus for heating a liquid includes: a mixing chamber; dispensing means; an electronic control device linked to the dispensing means; one or more pumps; a heat exchanger; one or more monitoring stations being arranged to communicate with the electronic control device; a waste outlet; and a second heat exchanger, wherein the mixing chamber, heat exchanger and the one or more monitoring stations are connected so as to form a loop; and wherein the electronic control device is programmed to cause reaction mixture to be circulated around the loop at least twice, and optionally to cause the dispensing means to dispense further metered amounts of first and/or second chemical reactants into the mixing chamber; and/or to cause a proportion of reaction mixture to be ejected through the waste outlet, in order to control the temperature of the reaction mixture passing through the heat exchanger.

19 Claims, 2 Drawing Sheets

(51) Int. Cl.

| | |
|---|---|
| ***F24H 1/00*** | (2006.01) |
| ***F22B 1/18*** | (2006.01) |
| ***F24D 3/00*** | (2006.01) |
| *B60H 1/03* | (2006.01) |
| *F24J 3/00* | (2006.01) |
| *F24H 7/02* | (2006.01) |

(58) Field of Classification Search

USPC ..... 122/21; 126/263.01, 263.05; 237/8 A, 237/8 D; 422/109–111, 198; 431/161

IPC ..... B60H 1/03; F24J 1/00,3/00; F24H 7/02

See application file for complete search history.

(56) References Cited

U.S. PATENT DOCUMENTS

| | | | | |
|---|---|---|---|---|
| 387,089 | A | 7/1888 | MacLaughin | |
| 1,506,323 | A | 6/1924 | O'Neil | |
| 1,869,651 | A | 8/1932 | Badger | |
| 3,064,902 | A * | 11/1962 | Moore | F24J 1/00 126/263.01 |
| 3,220,998 | A * | 11/1965 | Berger | B01J 19/0006 208/DIG. 1 |
| 3,227,526 | A * | 1/1966 | Scoggin | B01J 19/0006 422/111 |
| 3,418,804 | A * | 12/1968 | Meijer | C09K 5/16 122/21 |
| 3,563,226 | A | 2/1971 | Rockenfeller et al. | |
| 3,599,625 | A | 8/1971 | Curtis | |
| 3,651,797 | A | 3/1972 | Schroder et al. | |
| 3,911,896 | A * | 10/1975 | Charboneau | F24H 1/0045 122/21 |
| 3,927,983 | A * | 12/1975 | Gordon | B01J 19/18 422/110 |
| 4,009,575 | A | 3/1977 | Hartman et al. | |
| 4,044,821 | A | 8/1977 | Fletcher et al. | |
| 4,161,210 | A | 7/1979 | Reid et al. | |
| 4,175,283 | A | 11/1979 | Buchwald et al. | |
| 4,178,987 | A | 12/1979 | Bowman et al. | |
| 4,241,722 | A | 12/1980 | Dickinson | |
| 4,262,739 | A * | 4/1981 | Gruen | F03G 6/00 126/263.01 |
| 4,303,541 | A | 12/1981 | Wasel-Nielen et al. | |
| 4,309,980 | A * | 1/1982 | McCormack | C09K 5/16 126/263.05 |
| 4,325,355 | A | 4/1982 | Houser | |
| 4,589,479 | A * | 5/1986 | Gamo | F25B 17/12 126/263.01 |
| 5,190,730 | A | 3/1993 | Smith et al. | |
| 5,380,485 | A * | 1/1995 | Takahashi | B01J 19/004 422/106 |
| 6,241,953 | B1 | 6/2001 | Krijgsman | |
| 7,354,555 | B2 | 4/2008 | Yen et al. | |
| 7,438,871 | B2 | 10/2008 | Ha et al. | |
| 7,439,409 | B1 | 10/2008 | Jan et al. | |
| 7,479,215 | B2 | 1/2009 | Carson et al. | |
| 7,651,331 | B2 | 1/2010 | Veenstra | |
| 7,704,070 | B2 | 4/2010 | Veenstra | |
| 7,767,157 | B2 | 8/2010 | Shane et al. | |
| 8,187,554 | B2 | 5/2012 | Panagiotou et al. | |
| 8,424,515 | B1 | 4/2013 | MacCallum | |
| 2001/0018141 | A1 | 8/2001 | Kobayashi | |
| 2002/0134321 | A1 | 9/2002 | Alix et al. | |
| 2003/0211015 | A1 * | 11/2003 | Yen | G05D 7/0658 422/110 |
| 2004/0063567 | A1 | 4/2004 | Ginosar et al. | |
| 2005/0135989 | A1 | 6/2005 | Shane et al. | |
| 2006/0210468 | A1 * | 9/2006 | Veenstra | B01J 8/0278 423/456 |
| 2006/0210936 | A1 * | 9/2006 | Veenstra | B01J 4/002 431/11 |
| 2010/0101783 | A1 | 4/2010 | Vinegar et al. | |
| 2010/0282236 | A1 | 11/2010 | Xiao et al. | |
| 2010/0285416 | A1 * | 11/2010 | Moller | F23D 14/18 432/4 |
| 2011/0017443 | A1 | 1/2011 | Collins | |
| 2011/0165060 | A1 | 7/2011 | Milani et al. | |
| 2012/0286054 | A1 | 11/2012 | Collins | |

FOREIGN PATENT DOCUMENTS

| | | | | |
|---|---|---|---|---|
| EP | 1223379 | A1 | 7/2002 | |
| FR | EP 1223379 | A1 * | 7/2002 | B64D 13/00 |
| GB | 2028494 | | 3/1980 | |
| GB | 2028494 | A * | 3/1980 | B63C 11/28 |
| GB | 2381187 | A | 4/2003 | |
| GB | 2446820 | A | 8/2008 | |
| GB | WO 2008102164 | A1 * | 8/2008 | F24J 1/00 |
| JP | 07180539 | | 7/1995 | |
| JP | 09025479 | | 1/1997 | |
| JP | 10204422 | A * | 8/1998 | |
| SE | WO 8601880 | A1 * | 3/1986 | C09K 5/04 |
| WO | 8601880 | A1 | 3/1986 | |
| WO | 2004040645 | A1 | 5/2004 | |
| WO | 2008102164 | A1 | 8/2008 | |

* cited by examiner

APPARATUS FOR GENERATING HEAT

CROSS REFERENCE TO RELATED APPLICATIONS

This application is a continuation of U.S. Ser. No. 13/500,532, which is a national stage filing under section 371 of International Application No. PCT/GB2010/001884, filed on Oct. 7, 2010, and published in English on Apr. 14, 2011, as WO 2011/042702, and claims priority to British Application No. 0917546.4 filed on Oct. 7, 2009. The entire contents of each of the prior applications are hereby incorporated herein by reference.

This invention relates to an apparatus for generating heat for use in a heating system for liquids such as water.

BACKGROUND OF THE INVENTION

It is well known that many chemical reactions are exothermic, i.e. they produce heat, and examples of such reactions include acid-base reactions.

U.S. Pat. No. 4,325,355 describes a heating system in which an exothermic reaction between a solid metal and a solution takes place in a reactor containing a heat exchanger. In the specific reaction system described, aluminium pieces are lowered into a solution of sodium hydroxide solution. During the reaction between aluminium and sodium hydroxide solution, the aluminium is converted to aluminium hydroxide with the evolution of hydrogen gas. The aluminium hydroxide reacts with the sodium hydroxide to form sodium aluminate.

DE 3539710 describes a small scale heating system comprising an outer pouch containing an inner pouch partitioned to form two chambers containing reactive chemicals. Pressurizing the pouch (for example by kneading) causes the partition wall to rupture allowing the two reactive chemicals to react to produce heat. The reactive chemicals can be sodium hydroxide and acetic anhydride. The heating system of DE 3539710 is described as being particularly useful for warming hands and feet.

GB 2381187 discloses a method and apparatus for cleaning a surface. As part of the cleaning process, a cleaning solution is heated by the mixing of chemicals in an exothermic reaction.

WO 86/01880 describes a heating system that can be used for domestic water heating and which involves a multistage process comprising a first heat exchange step in which heat extracted from sea water is used to vaporize a liquefied gas such as ammonia. The ammonia vapour then passes to a second stage where it reacts either with sodium carbonate solution or carbon dioxide in an exothermic process, the heat from which is extracted to heat domestic water.

U.S. Pat. No. 4,044,821 describes an energy conversion and storage system in which chemical compounds such as ammonia or metal hydrides are decomposed using energy from, for example, a solar energy device. The decomposition products can be recombined in a later step to produce chemical energy.

WO 2004/040645 discloses a microfluidic heat exchanger for providing small scale heating and cooling control using exothermic and endothermic chemical reactions. The addition of sulphuric acid to water is disclosed as an example of an exothermic heating source.

U.S. Pat. No. 3,563,226 describes a heating system intended for use underwater or in oxygen-free environments in which an oxidizer such as pure oxygen is reacted with a pyrophoric material such as phosphorus.

U.S. Pat. No. 7,381,376 discloses steam/vapour generators in which the source of the heat is an exothermic chemical reaction.

DE 3819202 describes a system of heat storage using molten salts.

U.S. Pat. No. 4,303,541 describes latent heat storage devices that make use of saturated solutions of salts. The salts are formed by the reaction of an acid and a base, and there is a passing reference to the possibility that the heat generated in the reaction may be used elsewhere.

My earlier patent application WO2008/102164 discloses a method and apparatus for producing a supply of a heated fluid (e.g. water) wherein the method comprises passing the fluid through a heat exchanger unit where it is heated by a heat source which derives its heat from the exothermic reaction of two or more chemical reactants.

The present invention provides an improved apparatus for making use of the heat generated by exothermal chemical reactions to heat liquids such as the water in a water supply.

SUMMARY OF THE INVENTION

In a first aspect, the invention provides an apparatus for heating a liquid, which apparatus comprises:

a mixing chamber;

dispensing means for dispensing metered amounts of first and second chemical reactants into the mixing chamber to form a reaction mixture so that the chemical reactants undergo an exothermic chemical reaction to generate heat and one or more reaction products;

an electronic control device linked to the dispensing means for controlling the dispensing of the metered amounts of first and second chemical reactants;

one or more pumps for moving the chemical reactants and reaction mixture around the apparatus;

a heat exchanger having an inlet and an outlet for the reaction mixture and an inlet and an outlet for the said liquid, so that when said liquid passes through the heat exchanger it is heated by heat transfer from the reaction mixture;

one or more monitoring stations for monitoring one or more physical or chemical parameters of the reaction mixture; the monitoring stations being arranged to communicate with the electronic control device; and a waste outlet for removing spent reaction mixture from the apparatus;

wherein the mixing chamber, heat exchanger and the one or more monitoring stations are connected so as to form a loop; and wherein the electronic control device is programmed to cause the reaction mixture to be circulated around the loop at least twice, and optionally to cause the dispensing means to dispense further metered amounts of first and/or second chemical reactants into the mixing chamber; and/or to cause a proportion of the reaction mixture to be ejected through the waste outlet, in order to control the temperature of the reaction mixture passing through the heat exchanger.

Particular and preferred aspects and embodiments of the invention are as described below and as set out in the claims appended hereto.

In the apparatus of the invention, the mixing chamber, heat exchanger and the one or more monitoring stations are connected so as to form a loop; and the electronic control device is programmed to cause the reaction mixture to be circulated around the loop at least twice. When the apparatus is started up, the dispensing means dispenses initial charges of the two chemical reactants into the mixing chamber. The two reactants react exothermically to give rise to a heated reaction mixture which may contain only reaction products or a mixture of reactants and reaction products depending on the rate constant for the chemical reaction in question and the concentrations of the reactants. The heated reaction mixture is then directed through the heat exchanger, either directly or via one or more other system components such as a monitoring station and/or a mixer and/or a pump. In the heat exchanger, the heated reaction mixture transfers heat to a liquid (e.g. water for a water heating system) passing through the heat exchanger.

While passing through the heat exchanger, the reaction mixture may have given up all of its heat; i.e. the temperature of the reaction mixture may have returned to ambient temperature. However, an equally common (if not more common) scenario is that the reaction mixture may have given up only a proportion of its heat to the liquid in the heat exchanger. Furthermore, in some cases, the reaction between the first and second reactants may not have gone to completion and there may consequently be unreacted reactants in the reaction mixture. In such cases, it would be wasteful and inefficient to discharge the reaction mixture to waste. Instead, the apparatus of the invention is set up so that the reaction mixture moves in a loop and is returned to the mixing chamber. At this stage, depending upon the temperature difference between the reaction mixture and a predetermined target temperature required to heat the liquid passing through the heat exchanger, further charges of the first and/or second reactants may be dispensed into the mixing chamber to generate more heat. Thus the electronic controller may be programmed such that if the temperature of the reaction mixture exceeds a certain value, no further charges of reactants are introduced into the mixing chamber. Conversely, if the temperature of the reaction mixture has dropped below a predetermined value, the electronic controller prompts the dispensing means to dispense additional charges of one or both reactants. The reaction mixture, supplemented as required with further reactants is then circulated around the system for a second time. Thus, in the apparatus of the present invention, the reaction mixture is recycled one or more times after it has completed its initial passage around the loop.

By recycling the reaction mixture around the loop, the maximum amount of heat can be extracted from the reaction mixture.

Typically, the reaction mixture is circulated around the loop between two and twenty times, for example from three to twelve times. Preferably, the reaction mixture is circulated around the loop at least three times, and more usually at least four times.

The recycling of the reaction mixture around the loop and the addition of further charges of the two reactants are controlled by an electronic controller (a computer or microprocessor). The electronic controller is linked (electronically or wirelessly) to each of the monitoring stations and receives feedback on key physical and chemical parameters of the reaction mixture. Monitoring stations can be located at a number of positions in the loop.

In one embodiment, a monitoring station for monitoring one or more physical or chemical parameters of the reaction mixture is located downstream of the mixing chamber and upstream of the heat exchanger.

Alternatively or additionally, a monitoring station for monitoring one or more physical or chemical parameters of the reaction mixture can be located downstream of the heat exchanger and upstream of the mixing chamber.

A variety of different physical and chemical parameters may be monitored at the monitoring station, depending on the nature of the exothermic chemical reaction.

Typically, at least one monitoring station measures the temperature of the reaction mixture. Preferably the temperature is monitored by each of a plurality (e.g. two) of monitoring stations.

When the chemical reactants are an acid and a base, it is preferred that at least one monitoring station (and preferably two or more monitoring stations) measures the pH of the reaction mixture. Information fed back to the electronic controller is then used to determine whether further acid or base needs to be added to the mixture.

As the concentrations of reactants and reaction products in the reaction mixture increases, so the viscosity of the reaction mixture may increase leading to a reduction in the flow rate or an increase in the energy needed to pump the reaction mixture around the loop. Therefore, a monitoring station may comprise means for measuring the flow rate and/or viscosity of the reaction mixture.

In one preferred embodiment of the invention, the one or more physical or chemical parameters monitored by the monitoring stations are selected from the pH, temperature, flow rate and viscosity of the reaction mixture.

In another embodiment, the monitoring one or more monitoring stations each measure both the temperature and pH of the reaction mixture.

In order to enable efficient mixing of the reactants and thereby assist the reaction between the reactants to proceed to completion one or more further mixers (e.g. static in-line mixers) may be provided at various locations around the loop. The use of further in-line mixers is particularly beneficial at higher flow rates around the loop when maximal mixing is required in the shortest time.

For example, in one embodiment, a monitoring station is provided immediately downstream of the mixing chamber and an in-line mixer is interposed between the monitoring station and the heat exchanger.

In another embodiment, a monitoring station is provided downstream of the heat exchanger and upstream of the mixing chamber and an in-line mixer is located in the loop downstream of the monitoring station and upstream of the mixing chamber.

The apparatus is provided with a waste outlet so that spent (or substantially spent) reaction mixture can be removed from the system to make room for the addition of fresh reactants. The waste outlet is preferably linked to the electronic controller so that a proportion of the reaction mixture can be sent to waste when one or more physical or chemical parameters of the reaction mixture falls below or exceeds a predetermined value.

For example, if all of the heat has been extracted from the reaction mixture in the heat exchanger (i.e. the temperatures of the reaction mixture and the liquid passing through the heat exchanger are substantially the same), a proportion of the reaction mixture may be sent to waste to enable fresh reactants to be introduced into the mixing chamber to generate more heat.

Furthermore, as the reaction progresses, the viscosity of the reaction mixture will typically increase and the electronic controller may instruct the waste outlet to open to allow release of a proportion of the reaction mixture once the viscosity has exceeded a predetermined value.

In many cases, the recycling of the reaction mixture may lead to the concentrations of reaction products increasing to the point where a saturated solution is formed and reaction products begin to precipitate or crystallise out of solution.

When the reactants are acids and bases, salts may typically begin to precipitate or crystallise out of solution after about three or four cycles. A settling tank may therefore be provided at or adjacent the waste outlet to allow solid material to settle out of the reaction mixture before removal through the waste outlet.

The waste outlet is typically located downstream of the heat exchanger and, in one embodiment, is disposed at or immediately adjacent a monitoring station downstream of the heat exchanger.

In one embodiment of the invention, the electronic control device is programmed to cause a proportion of the reaction mixture to be ejected through the waste outlet when the viscosity of the reaction mixture exceeds a predetermined value and/or the flow rate of the reaction mixture around the loop is less than a predetermined value.

The apparatus of the invention may be operated for a period of time over which a supply of heated liquid is required and the electronic controller may be programmed or otherwise set up to provide a defined amount of heat during the operating period. Typically the electronic controller will contain means for selecting a desired temperature (target temperature) for the liquid during the period of time over which the apparatus is operated.

At the end of the period of operation, the spent reaction mixture is typically ejected from the system and the loop and optionally other components of the system are flushed (e.g. with water) to remove any residual traces of reaction products.

After flushing, the apparatus, or at least the loop, may be drained down in readiness for the next heating session.

Accordingly, in one embodiment, the electronic control device is programmed to provide a flushing step at the end of a predetermined period of heating, the flushing step serving to flush out of the apparatus any residual reaction mixture. Preferably, the electronic control device is programmed to provide a drainage step following the flushing step.

The chemical reactants are typically contained within storage containers forming part of the apparatus. Preferably the chemical reactants are introduced into the mixing chamber via the dispensing means in the form of solutions, on the basis that it is easier to provide accurate metering of the amounts of reactants added when they are in liquid form than when they are in solid form.

Some chemical reactants may be stored in their storage containers in the form of solids and then dissolved to form solutions immediately before passing through the dispensing means and being introduced into the mixing chamber. This is particularly preferred where the solid form of the reactant is stable and has good handling characteristics and where the dissolution of the reactant in the solvent is an exothermic process. In such a case, the heat generated by the dissolution of the reactant can be made use of, for example to raise the temperature of the other reactant so that the temperatures of the two reactants as they pass through the dispensing means are similar or substantially identical. To allow transfer of heat between the two reactant solutions, a second heat exchanger may be provided upstream of the dispensing means.

Accordingly, in one preferred embodiment of the invention, the apparatus comprises a second heat exchanger, the second heat exchanger being located externally of the loop and upstream of the dispensing means, and having an inlet and an outlet for the first chemical reactant and an inlet and an outlet for the second chemical reactant, so that heat may be exchanged between the first and second chemical reactants without mixing of the reactants.

A mixer may be provided upstream of the second heat exchanger, and dosing means provided for introducing into the mixer one of the first and second reactants and a solvent therefor.

The dispensing means may comprise individual dispensing devices for each of the reactants or a unitary metering and dispensing device through which both reactants pass. The dispensing device may also have an inlet for receiving recycled reaction mixture and an outlet for dispensing recycled reaction mixture into the mixing chamber. Thus the dispensing device may form part of the loop.

In one embodiment, the first and second chemical reactants are an acid and a base.

Preferably the acid is selected from mineral acids and carboxylic acids.

The acid may be selected from acids having a pka value of >0, more typically >2 and preferably >3, e.g. a pKa in the range 3 to 7.

The acid may be a polybasic acid, one preferred acid being citric acid.

The base is preferably selected from alkali metal hydroxides, alkaline earth metal hydroxides, alkali metal carbonates, alkaline earth metal carbonate, alkali metal bicarbonates, alkaline earth metal bicarbonate, and amines, and mixtures thereof.

Examples of alkali metal hydroxides are lithium hydroxide, sodium hydroxide and potassium hydroxide.

Examples of alkaline earth metal carbonates are magnesium hydroxide and calcium hydroxide.

Examples of alkali metal bicarbonates are sodium bicarbonate and potassium bicarbonate.

Particular bases are basic amines and in particular mono-, di- and trialkylamines and hydroxy derivatives thereof.

One group of preferred bases consists of mono-, di- and trialkylamines and hydroxy derivatives thereof in which each alkyl group contains from 1 to 4 carbon atoms, more preferably 1 to 3 carbon atoms and most preferably 1 or 2 carbon atoms. Such bases include methylamine, dimethylamine, trimethylamine, ethylamine, diethylamine, triethylamine, monoethanolamine and diethanolamine.

In one embodiment, the base is sodium hydroxide.

In another embodiment, the base is a mixture of sodium, hydroxide and monoethanolamine.

In another embodiment, the first reactant is aluminium and the second reactant is a metal hydroxide, preferably an alkali metal hydroxide (such as sodium hydroxide or potassium hydroxide) and most preferably sodium hydroxide.

Preferably the aluminium is in powder form.

In another aspect, the invention provides an apparatus for heating a liquid, which apparatus comprises:

a first storage container containing a first chemical reactant which comprises aluminium in powder form;

a second storage container containing a second chemical reactant which comprises an alkali metal hydroxide;

a mixing chamber;

dispensing means for dispensing metered amounts of the first and second chemical reactants the first and second storage containers into the mixing chamber to form a reaction mixture so that they undergo an exothermic chemical reaction to generate heat and reaction products, one of the reaction products being hydrogen gas;

an electronic control device linked to the dispensing means for controlling the dispensing of the metered amounts of first and second chemical reactants;

one or more pumps for moving the chemical reactants and reaction mixture around the apparatus;

a heat exchanger having an inlet and an outlet for the reaction mixture and an inlet and an outlet for the said liquid, so that when said liquid passes through the heat exchanger it is heated by heat transfer from the reaction mixture;

one or more monitoring stations for monitoring one or more physical or chemical parameters of the reaction mixture; the monitoring stations being arranged to communicate with the electronic control device; and a waste outlet for removing one or more non-gaseous reaction products from the apparatus;

an outlet for removing hydrogen gas from the apparatus; wherein the mixing chamber, heat exchanger and the one or more monitoring stations are connected so as to form a loop; and wherein the electronic control device is programmed to cause the reaction mixture to be circulated around the loop at least twice, and optionally to cause the dispensing means to dispense further metered amounts of first and/or second chemical reactants into the mixing chamber; and/or to cause a proportion of the reaction mixture to be ejected through the waste outlet, in order to control the temperature of the reaction mixture passing through the heat exchanger.

The aluminium is preferably introduced into the mixing chamber in the form of an aqueous slurry. Preferably the aluminium powder is mixed with water to form a slurry immediately before entry into the mixing chamber.

The alkali metal hydroxide is typically sodium hydroxide or potassium hydroxide and preferably is sodium hydroxide.

The reaction between aluminium and aqueous sodium hydroxide initially consumes sodium hydroxide and produces sodium aluminate which undergoes a decomposition reaction when its concentration exceeds the saturation limit. A crystalline precipitate of aluminium hydroxide is produced with the regeneration of the alkali. Overall only aluminium and water are consumed, so that the role of the alkali in this process can be seen as being catalytic.

A first waste outlet for removing one or more non-gaseous reaction products from the apparatus is typically located between the mixing chamber and the heat exchanger. Precipitated crystalline aluminium hydroxide (or other precipitated reaction product) is preferably removed at the said waste outlet. Accordingly, the waste outlet may be provided with a filter for filtering off precipitated reaction product or a settling chamber in which precipitated reaction product can settle out and be withdrawn through the waste outlet.

Although crystalline aluminium hydroxide (or other precipitated reaction product) may be removed at the waste outlet, further precipitation may occur downstream of the waste outlet as the reaction mixture cools down. In order to prevent precipitation, a third chemical reactant may be introduced into the apparatus downstream of the first waste outlet and upstream of the heat exchanger.

The third chemical reactant may be an alkali metal borohydride such as sodium borohydride. Sodium borohydride reacts with the aluminium hydroxide to generate heat and produce further hydrogen. The heating boost provided by the reaction prevents precipitation of reaction products from taking place in the heat exchanger.

Hydrogen produced by the reaction can either be separated by means of a liquid-gas separator disposed upstream of the heat exchanger or can be removed when the reaction mixture is recycled back to the mixing chamber.

The apparatuses of the invention are particularly useful for heating water.

Accordingly, the apparatus may form part of a domestic water heating system or an industrial or commercial water heating system.

In one embodiment, the apparatus forms part of a water heating system intended to provide water for central heating or sanitation purposes.

In another embodiment, the apparatus forms part of a water heating system for a swimming pool.

In another aspect, the invention provides a method of heating a liquid which method comprises passing the liquid through the heat exchanger of an apparatus as defined herein.

A substantial advantage of the apparatus of the invention is that it provides a very efficient means for heating a liquid such as water whereby heating losses to the external environment are minimised. Heat losses may be minimised still further by insulating the components of the apparatus in conventional fashion.

A further advantage of the apparatus of the invention is that it can be used in locations where mains electricity or mains gas supplies are not available or are restricted. Thus, although electrical power is required to operate the apparatus, the amount of power required is relatively small and can therefore be supplied by renewable resources such as a wind turbine or solar power.

The invention will now be illustrated in more detail (but not limited) by reference to the specific embodiment shown in the accompanying drawings.

DETAILED DESCRIPTION OF THE INVENTION

Figure 1:
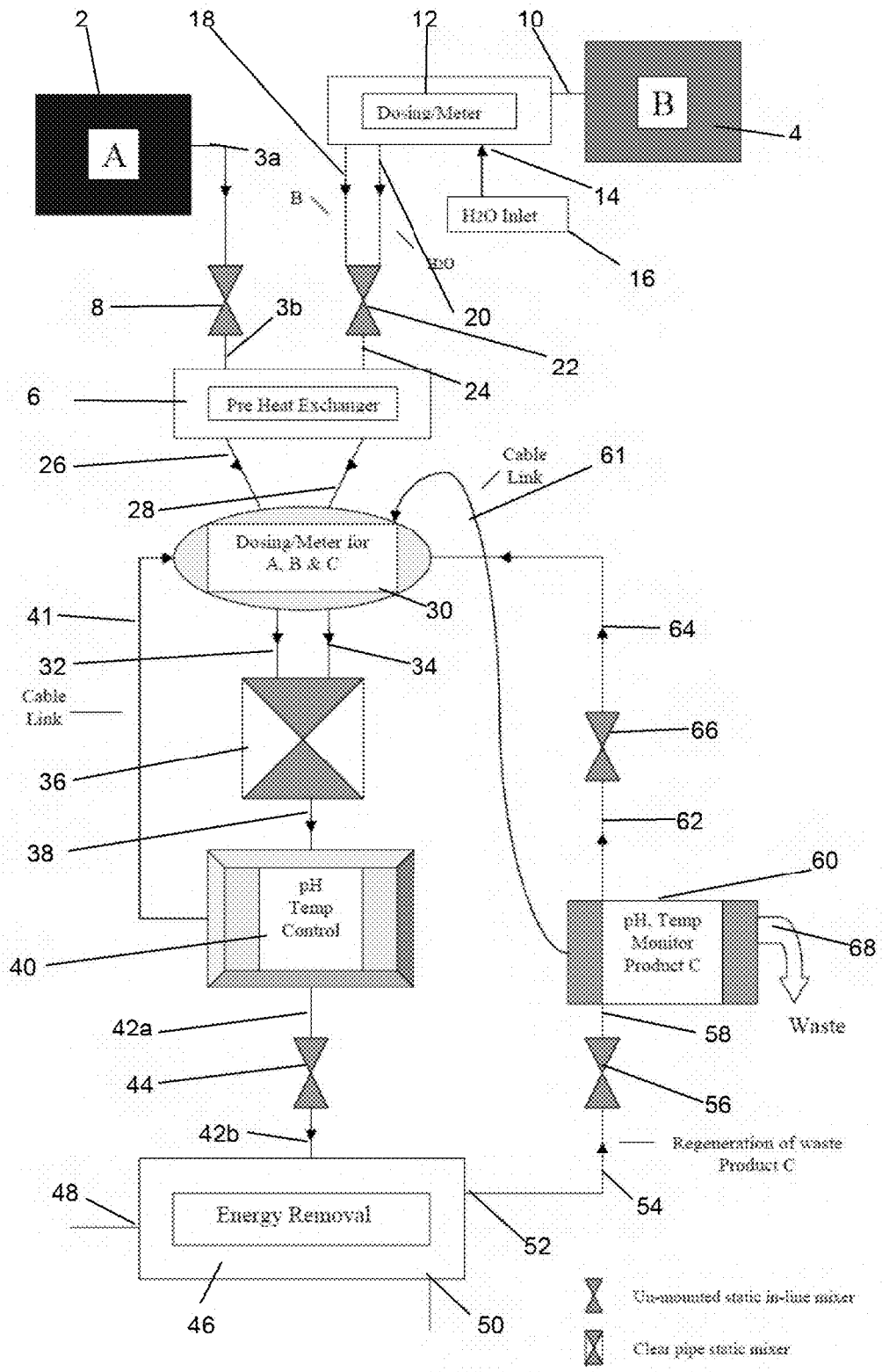
FIG. 1 is a schematic view of an apparatus according to one embodiment of the invention.

As shown in FIG. 1, an apparatus for producing heat according to one embodiment of the invention comprises storage containers 2 and 4, each of which contains a component of an exothermic chemical reaction system. Storage container 2 is connected via pipes 3*a* and 3*b* to a heat exchanger 6, an optional static in-line mixer 8 being located between the container 2 and the heat exchanger 6.

Container 4 is connected by pipe 10 to a first dosing/metering station 12. Dosing/metering station 12 has an inlet 14 for receiving water from a water supply (represented schematically by the number 16) and pair of outlets which are connected via pipes 18 and 20 to a static in-line mixer 22 and thence via pipe 24 to the heat exchanger 6 (which constitutes the second heat exchanger as hereinbefore defined).

The heat exchanger 6 has two outlets, one for each of the components of the exothermic reaction system (they do not mix in the heat exchanger), the two outlets leading via pipes 26 and 28 to the main dosing/metering station 30 (which constitutes the dispensing means as hereinbefore defined). The main dosing/metering device 30 has a pair of outlets (one for each component of the exothermic reaction system) which lead via pipes 32 and 34 to a clear pipe static mixer 36 (which constitutes the mixing chamber as hereinbefore defined).

The static mixer is 36 connected via a single outlet via pipe 38 to a first product monitoring station 40 which in turn is linked by pipes 42*a* and 42*b* and static in-line mixer 44 to the main heat exchanger 46. The first product monitoring station 40 is linked electronically by cable 41 to the main dosing/metering station 30. As an alternative to being linked by cable, a wireless connection to the dosing/metering station 30 could be provided instead.

The heat exchanger 46 has an inlet 48 and an outlet 50 for water and an outlet for the products of the exothermic chemical reaction. Outlet 52 leads via pipe 54, static in-line mixer 56 and pipe 58 to a second product monitoring station 60. The second product monitoring station 60 has an outlet that leads back via pipes 62 and 64 and static in-line mixer 66 to the main dosing/metering station 30. The second product monitoring station 60 also has a waste outlet 68 for the removal of spent reactants. The second product monitoring station 60 is also linked electronically by cable 61 (or wirelessly) to the main dosing/metering device 30.

Each of the component parts of the system shown in FIG. 1 is thermally insulated to reduce or prevent heat loss, with the exception in certain cases of the elements of the system preceding the first heat exchanger 6. Thus, for example, in cases where the first step in the process involves dissolving one of the chemical reactants in a solvent such as water, and the dissolution process is endothermic, the container for that chemical reactant and the associated pipework leading to the first heat exchanger 6 may be left uninsulated to allow the solution of dissolved reactant to take in heat from its surroundings and come up to ambient temperature.

The system illustrated in FIG. 1 is particularly suitable for use in generating and using heat from the endothermic reaction between an acid and a base, although it may be used and/or adapted for use with other combinations of chemical reactants.

Thus, with reference to the particular example of the reaction of citric acid with sodium hydroxide or a mixture of sodium hydroxide and monoethanolamine, the heat generating system of the invention functions in the following manner.

Sodium hydroxide pellets from the container 4 are conveyed by eccentric screw pump (not shown) along pipe 10 to the first dosing/metering station 12 where a metered quantity of the pellets is moved by a progressive cavity pump (not shown) along outlet pipe 18 to the static in-line mixer 22. At the same time, a charge of monoethanolamine (for example in an amount corresponding to about 1% to 15% by weight relative to the sodium hydroxide) is conveyed from a reservoir (not shown) through the first dosing/metering station 12 and along pipe 18 to the in-line mixer. Water from source 16 enters the dosing/metering station 12 through inlet 14 and a metered amount is then directed along outlet pipe 20 to the static in-line mixer 22 where it is mixed with the sodium hydroxide and ethanolamine.

The reaction between the sodium hydroxide and the water is exothermic and represents the first heat generating stage of the process. The resulting warm aqueous solution of sodium hydroxide and ethanolamine is then directed along pipe 24 to the heat exchanger 6.

An aqueous solution of citric acid from the container 2 is directed along pipes 3*a* and 3*b* via static in-line mixer 8 to the first heat exchanger where it exchanges heat with (but does not mix with) the flow of sodium hydroxide and ethanolamine solution. The transfer of heat between the two streams of reactants results in the temperatures of the two streams moving towards parity.

After exiting the first heat exchanger 6 and moving along pipes 26 and 28 respectively, the streams of citric acid solution and sodium hydroxide/ethanolamine solution enter the main dosing/metering station 30.

At the start of the heat generation process, the dosing/metering station 30 dispenses charges of citric acid solution and sodium hydroxide/monoethanolamine solution in a 1:3 molar ratio of acid:base along pipes 32 and 34 into the clear pipe static mixer 36. An exothermic reaction between the citric acid and sodium hydroxide takes place in the mixer 36 to form citrate salts and generate heat. The warm reaction mixture is then passed along pipe 38 and into the first product monitoring station 40 where the pH and temperature of the mixture are measured and the measurements sent back along cable 41 to a an electronic computerised controller forming part of the dosing/metering station 30. The product monitoring station 40 may also include a flow meter for measuring the flow rate of the reaction mixture.

After the product monitoring station 40, the reaction mixture is directed via pipes 42*a* and 42*b* and static in-line mixer 44 to the main heat exchanger 46. At the heat exchanger 46, heat is transferred from the warm reaction mixture to a stream of water for a warm/hot water supply (e.g. water for a domestic hot water supply or a heated swimming pool).

Having given up all or some of its heat, the reaction mixture leaves the heat exchanger 46 and travels via pipe 54, static in-line mixer and pipe 58 to the second product monitoring station 60. At monitoring station 60, the pH and temperature are again measured and the measurements sent along cable 61 to the controller at the dosing/metering station 30.

After leaving the second product monitoring station 60, the reaction mixture is directed through pipe 62, static in-line mixer and pipe 64 back to the main first dosing/metering station 30 to complete a first cycle.

During its progress around the first cycle, the sodium hydroxide and monoethanolamine may have undergone complete reaction with the citric acid or only partial reaction. The reaction mixture may therefore contain unreacted acid or base as well as dissolved citrate salt. In addition, the temperature of the reaction mixture may still be higher than the target temperature of the water passing through the heat exchanger.

At the end of the first cycle therefore, depending on the temperature excess (with respect to the target temperature for the water), and the pH of the reaction mixture, further charges of citric acid solution and/or sodium hydroxide/monoethanolamine may be dispensed from the main dosing/metering station 30 into the pipes 32 and 34 leading to the mixer 36. Alternatively, the controller may be programmed such that if the temperature differential between the reaction mixture and the target temperature for the water passing through the main heat exchanger 46 exceeds a predetermined value, no additional acid or base is dispensed into the mixer 36.

Subsequently, if the product monitoring stations 40 and 60 detect that the temperature of the reaction mixture has fallen below a predetermined value necessary to heat the water entering the main heat exchanger 46 to the target temperature, further charges of acid and base may be dispensed into the mixer 36.

Top up additions of acid and base may be made as and when necessary in order to maintain the reaction mixture at the desired temperature.

By recycling the reaction mixture and carefully monitoring the pH and temperature of the mixture and adding further charges of acid and base as needed, the greater part of the heat generated from the exothermic reaction of the citric acid and the sodium hydroxide/ethanolamine can be extracted and transferred to the water passing through the main heat exchanger. Because the system is well insulated, very little heat is lost to the surroundings.

The system illustrated in FIG. 1 is provided with one or more flow meters (not shown) which may form part of the product monitoring stations 40 and 60 or may be located at other points in the circuit.

During each heat-generating session, the reaction mixture may be repeatedly circulated around the system, for example at least five times and more usually up to about ten times or more. At intervals, spent reaction mixture may be discharged through the waste exit 68 where it may be collected for recycling and reprocessing. The mixture may be discharged as and when necessary to create room for more acid or base to be introduced into the system.

After several cycles, the reaction mixture may reach the state of a saturated solution and citrate salts may begin to precipitate or crystallise out of solution. This process may be accelerated as heat is removed from the reaction mixture by the main heat exchanger 46. The second product monitoring station may therefore incorporate or be linked to a settling tank or chamber (not shown) in which precipitated or crystallised salts can settle out thereby enabling them to be removed more easily. In order to minimise heat loss from the system, the spent reaction mixture and precipitated or crystallised salts are preferably removed at a time point when the temperature of the reaction mixture is at or near its coolest value.

The heating process is continued as described above for a required period of time (e.g. the time necessary to heat a desired volume of water to a given target temperature), and the system is then flushed with clean water to remove salts and any residual acid and base. After flushing, the system is automatically drained down (e.g. through the waste outlet 68) to leave the system ready for the next heating session.

The heating system of the invention functions as a partially closed system. When starting up the process, air is driven out of the system through valves or air vents (not shown) which are then closed to prevent loss of the reaction mixture. The reaction mixture is then continuously recycled around the system, the system being opened at intervals to allow the addition of further charges of acid and base and to permit spent reaction mixture to be discharged to waste. By keeping the system closed between additions of reactants and the discharge of spent reaction mixture, substantially all available heat can be extracted from the system. This represents a substantial advantage of the method and apparatus of the invention and provides a contrast with heating systems such as oil or gas burning systems where much of the heat produced is lost with the flue gases.

Figure 2:
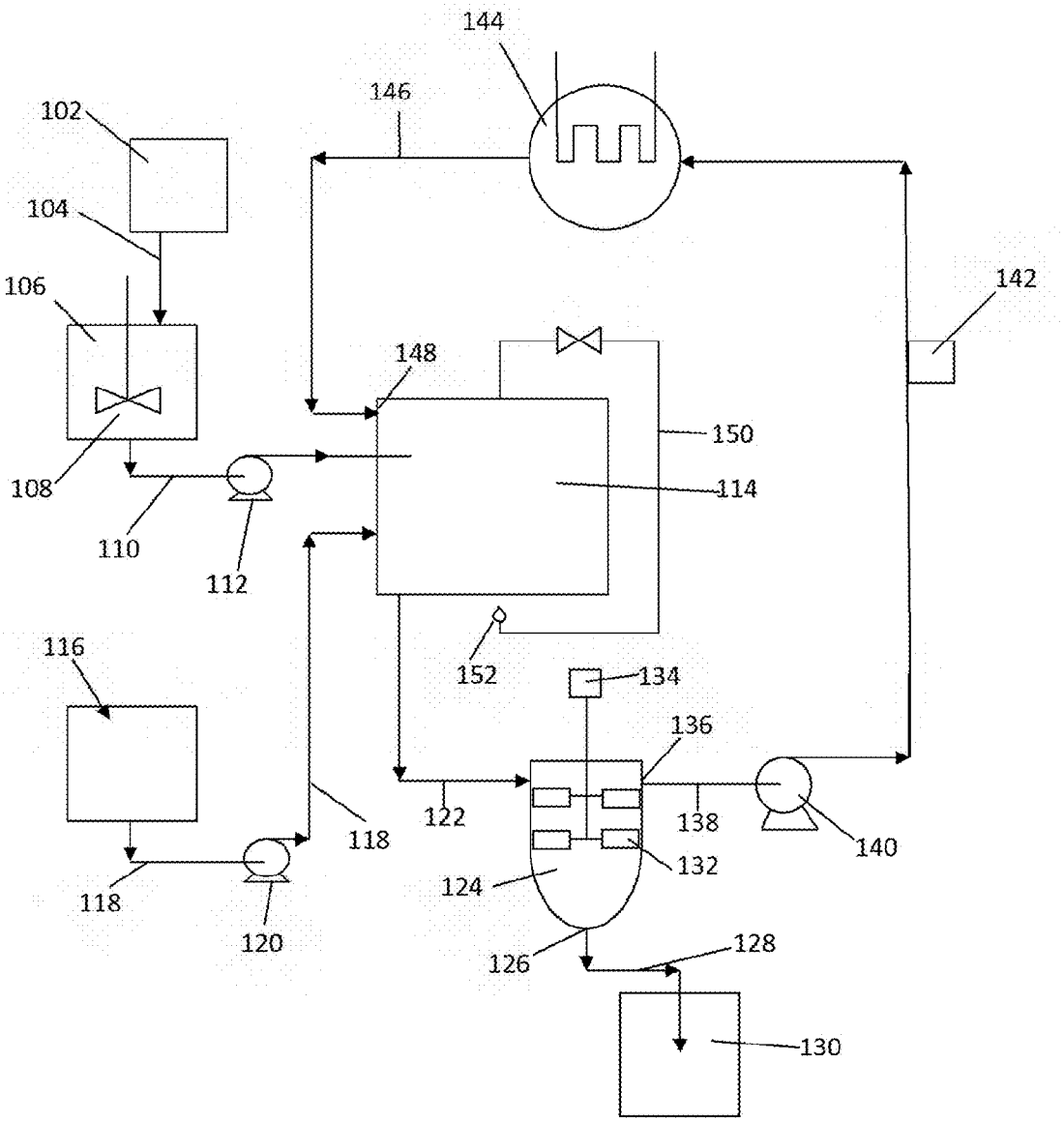
FIG. 2 is a schematic view of an apparatus according to a second embodiment of the invention.

An apparatus according to a second embodiment of the invention is illustrated in FIG. 2.

As shown in FIG. 2, the apparatus comprises a first storage container 102 containing aluminium powder linked via pipe 104 to a preliminary mixing tank 106 fitted with a stirrer 108. The preliminary mixing tank is connected via pipe 110 and pump 112 to the mixing chamber 114.

A second storage container 116 containing concentrated aqueous sodium hydroxide is connected via pipe 118 and pump 120 to the mixing chamber 114.

The mixing chamber 114 has an outlet at its lower end connecting via pipe 122 to a first waste outlet chamber 124 having a waste outlet 126 leading via pipe 128 to a waste tank 130. The waste outlet chamber 124 is provided with a scraper device comprising a plurality of blades 132 mounted on a rotating spindle driven by a motor 134.

The waste outlet chamber 124 has a further outlet 136 connected to pipe 138 which leads via pump 140 and third reactant dosing station 142 to the heat exchanger 144. The heat exchanger is connected by pipe 146 to the recycling inlet 148 of the mixing chamber 114.

At the upper end of the mixing chamber 114 is a hydrogen gas vent which is connected via pipe 150 to a burner 152.

In use, a metered amount of aluminium powder from the first storage container 102 is charged into the preliminary mixing tank 106 and water (water inlet not shown) is added. The mixture is stirred vigorously to form a slurry and rapidly pumped along pipe 106 to the mixing chamber 114. By adding the water to the aluminium to form the slurry immediately prior to charging it into the mixing chamber, loss of heat due to any initial reaction between the aluminium and water is minimised.

A metered amount of concentrated sodium hydroxide solution from the second storage container 116 is pumped via pipe 118 and pump 120 into the mixing chamber where it reacts with the aluminium.

Hydrogen gas produced by the reaction of the aluminium and the sodium hydroxide is vented through the outlet at the upper end of the mixing chamber 114 and is conveyed through pipe 150 to the burner 152 where it is combusted to provide an additional source of heat for the mixing chamber.

After allowing reaction between the sodium hydroxide and aluminium to take place in the mixing chamber 114, the reaction mixture is allowed to pass out of the outlet in the lower end of the mixing chamber along pipe 122 to the waste outlet chamber 124. In the waste outlet chamber, precipitated aluminium hydroxide settles to the bottom of the chamber and is drained away via waste outlet 126 and pipe 128 to the waste tank 130. Any aluminium hydroxide crystallizing on the walls of the chamber 124 is scraped off by the motorized rotating scraper device 132, 134 and allowed to fall to the bottom of the chamber.

The reaction mixture exits the waste outlet chamber through outlet 136 and is pumped by pump 140 along pipe 138 to the heat exchanger 144 where the heat is used to heat water flowing through the heat exchanger.

Although the pipework is fully insulated, there is likely to be some heat loss between the waste outlet chamber and the heat exchanger and this may lead to further aluminium hydroxide precipitating out in the pipes and in the heat exchanger thereby leading to blockages. In order to prevent this from occurring, a third reactant is introduced at station 142. The third reactant in this case is sodium borohydride which reacts with the aluminium hydroxide.

The heat generated by the reaction is sufficient to maintain the temperature at a level whereby supersaturation and precipitation does not occur. In addition, further hydrogen is generated which can either be extracted at a gas-liquid separator (not shown) or removed from the mixture once the reaction mixture re-enters the mixing chamber 114 through recycling inlet 148.

Once the reaction mixture has re-entered the mixing chamber, a further charge of aluminium is introduced into the chamber to continue the cycle. Although the sodium hydroxide functions in a catalytic manner, some of the sodium hydroxide will typically be lost to waste at the first waste outlet chamber 124. A further charge of sodium hydroxide may therefore be added from storage container 116.

As with the embodiment of FIG. 1, the apparatus of FIG. 2 is typically provided with one or more product monitoring stations for monitoring one or more physicochemical properties of the reaction mixture (e.g. the pH or the temperature) to determine when further reactants need to be added. The apparatus may be set up to dispense further charges of reactants automatically or may provide a prompt to the user to make the necessary adjustments manually.

As with the apparatus of FIG. 1, the reaction mixture is pumped around a partially closed loop and is recycled a number of times in order to allow optimal extraction of heat before discharging to waste.

The embodiments described above and illustrated in the accompanying figures and tables are merely illustrative of the invention and are not intended to have any limiting effect. It will readily be apparent that numerous modifications and alterations may be made to the specific embodiments shown without departing from the principles underlying the invention. All such modifications and alterations are intended to be embraced by this application.

The invention claimed is:

1. An apparatus for heating a liquid, which apparatus comprises:

a mixing chamber;

dispensing means for dispensing metered amounts of first and second chemical reactants into the mixing chamber to form a reaction mixture so that the chemical reactants undergo an exothermic chemical reaction to generate heat and one or more reaction products;

an electronic control device linked to the dispensing means for controlling the dispensing of the metered amounts of first and second chemical reactants;

one or more pumps for moving the chemical reactants and reaction mixture around the apparatus;

a first heat exchanger having an inlet and an outlet for the reaction mixture and an inlet and an outlet for the said liquid, so that when said liquid passes through the first heat exchanger it is heated by heat transfer from the reaction mixture;

a second heat exchanger;

one or more monitoring stations for monitoring one or more physical or chemical parameters of the reaction mixture; the one or more monitoring stations being arranged to communicate with the electronic control device; and a waste outlet for removing spent reaction mixture from the apparatus;

wherein the mixing chamber, first heat exchanger and the one or more monitoring stations are connected so as to form a loop; and wherein the electronic control device is programmed to cause the reaction mixture to be circulated around the loop at least twice, and optionally to cause the dispensing means to dispense further metered amounts of first and/or second chemical reactants into the mixing chamber; and/or to cause a proportion of the reaction mixture to be ejected through the waste outlet, in order to control the temperature of the reaction mixture passing through the first heat exchanger;

and wherein the second heat exchanger is located externally of the loop and upstream of the dispensing means, and having an inlet and an outlet for the first chemical reactant and an inlet and an outlet for the second chemical reactant, so that heat may be exchanged between the first and second chemical reactants without mixing of the reactants.

2. An apparatus according to claim 1 wherein one of the said one or more monitoring stations for monitoring one or more physical or chemical parameters of the reaction mixture is located downstream of the mixing chamber and upstream of the heat exchanger.

3. An apparatus according to claim 2 wherein an in-line mixer is interposed between the one or more monitoring station and the heat exchanger.

4. An apparatus according to claim 1 wherein one of the one or more monitoring stations for monitoring one or more physical or chemical parameters of the reaction mixture is located downstream of the heat exchanger and upstream of the mixing chamber.

5. An apparatus according to claim 4 wherein an in-line mixer is located in the loop downstream of the one or more monitoring station and upstream of the mixing chamber.

6. An apparatus according to claim 1 wherein the one or more physical or chemical parameters monitored by the said one or more monitoring stations are selected from the pH, temperature, flow rate and viscosity of the reaction mixture.

7. An apparatus according to claim 1 wherein a mixer is provided upstream of the second heat exchanger, and dosing means are provided for introducing into the mixer one of the first and second reactants and a solvent therefor.

8. An apparatus according to claim 1 wherein storage containers are provided for storing the first and second chemical reactants, wherein the storage containers are in fluid communication with the dispensing means and the second heat exchanger.

9. An apparatus according to claim 1 wherein the electronic control device is programmed to cause the reaction mixture to be circulated around the loop between two and ten times.

10. An apparatus according to claim 1 wherein the electronic control device is programmed to cause the dispensing means to dispense one or more further doses of the first and/or second reactants if the temperature of the reaction mixture falls below a predetermined value.

11. An apparatus according to claim 1 wherein the first chemical reactant is an acid and the second chemical reactant is a base and the electronic control device is programmed (i) to cause the dispensing means to dispense one or more further doses of the acid if the pH of the reaction mixture exceeds a predetermined value; or (ii) to cause the dispensing means to dispense one or more further doses of the base if the pH of the reaction mixture falls below a predetermined value.

12. An apparatus according to claim 1 wherein the electronic control device is programmed to provide a flushing step at the end of a predetermined period of heating, the flushing step serving to flush out of the apparatus any residual reaction mixture, and further wherein the electronic control device is programmed to provide a drainage step following the flushing step.

13. An apparatus according to claim 1 wherein the first reactant is aluminium and the second reactant is an alkali metal hydroxide.

14. An apparatus according to claim 13 wherein the aluminium is in powder form.

15. An apparatus according to claim 13 wherein the alkali metal hydroxide is sodium hydroxide.

16. An apparatus according to claim 1 wherein the liquid to be heated is water.

17. An apparatus according to claim 1 which forms part of a domestic water heating system or an industrial or commercial water heating system.

18. An apparatus according to claim 17 wherein the water heating system provides water for central heating or sanitation purposes.

19. An apparatus for heating a liquid, which apparatus comprises:

a first storage container containing a first chemical reactant which comprises aluminium in powder form;

a second storage container containing a second chemical reactant which comprises an alkali metal hydroxide;

a mixing chamber;

dispensing means for dispensing metered amounts of the first and second chemical reactants the first and second storage containers into the mixing chamber to form a reaction mixture so that the undergo an exothermic chemical reaction to generate heat and reaction products, one of the reaction products being hydrogen gas;

an electronic control device linked to the dispensing means for controlling the dispensing of the metered amounts of first and second chemical reactants;

one or more pumps for moving the chemical reactants and reaction mixture around the apparatus;

a first heat exchanger having an inlet and an outlet for the reaction mixture and an inlet and an outlet for the said liquid, so that when said liquid passes through the first heat exchanger it is heated by heat transfer from the reaction mixture;

a second heat exchanger;

one or more monitoring stations for monitoring one or more physical or chemical parameters of the reaction mixture; the one or more monitoring stations being arranged to communicate with the electronic control device;

a waste outlet for removing one or more non-gaseous reaction products from the apparatus; and an outlet for removing hydrogen gas from the apparatus;

wherein the mixing chamber, first heat exchanger and the one or more monitoring stations are connected so as to form a loop; and wherein the electronic control device is programmed to cause the reaction mixture to be circulated around the loop at least twice, and optionally to cause the dispensing means to dispense further metered amounts of first and/or second chemical reactants into the mixing chamber; and/or to cause a proportion of the reaction mixture to be ejected through the waste outlet, in order to control the temperature of the reaction mixture passing through the first heat exchanger;

and wherein the second heat exchanger is located externally of the loop and upstream of the dispensing means, and having an inlet and an outlet for the first chemical reactant and an inlet and an outlet for the second chemical reactant, so that heat may be exchanged between the first and second chemical reactants without mixing of the reactants.

* * * * *